United States Patent [19]

Grundman

[11] 4,150,487

[45] Apr. 24, 1979

[54] INSTRUMENT FOR TRACING CURVED FIGURES PARTICULARLY ELLIPSES

[76] Inventor: Aharon P. Grundman, 24 Amsterdam St., Tel Aviv, Israel

[21] Appl. No.: 908,280

[22] Filed: May 22, 1978

[51] Int. Cl.[2] ..... B43L 11/04

[52] U.S. Cl. ..... 33/30 R

[58] Field of Search ..... 33/27 K, 30 R, 30 G, 33/30 C

[56] References Cited

U.S. PATENT DOCUMENTS

| | | | |
|---|---|---|---|
| 1,847,997 | 3/1932 | Bennett | 33/30 G |
| 2,393,698 | 1/1946 | Moen | 33/30 C |
| 4,010,546 | 3/1977 | Tien | 33/30 C |

FOREIGN PATENT DOCUMENTS

| | | | |
|---|---|---|---|
| 25874 | 10/1906 | Austria | 33/30 B |
| 476999 | 5/1929 | Fed. Rep. of Germany | 33/30 G |

*Primary Examiner*—Harry N. Haroian
*Attorney, Agent, or Firm*—Benjamin J. Barish

[57] ABSTRACT

A hand-held compass-type instrument for tracing curved figures, particularly ellipses, is described comprising a manipulatable finger-gripping element; an anchor arm pivotably mounted at one end to one end of the finger-gripping element, the opposite end of the anchor arm being adapted to be anchored to the surface on which the curved figure is to be traced; a tracing arm pivotably mounted at one end to the finger-gripping element, the opposite end of the tracing arm being adapted to trace the curved figure; and an eccentric linkage, having presettable means for presetting its eccentricity, coupled between the anchor and tracing arms for constraining the tracing arm to pivot in a presettable eccentric manner with respect to the anchor arm when the finger-gripping element is manipulated to trace the figure.

9 Claims, 5 Drawing Figures

INSTRUMENT FOR TRACING CURVED FIGURES PARTICULARLY ELLIPSES

BACKGROUND OF THE INVENTION

The present invention relates to instruments for tracing or drawing curved figures. The invention is particularly directed to a hand-held compass-type instrument for tracing ellipses.

Many instruments for tracing ellipses have been designed and are now in use. Most of the known instruments include various constructions containing a flexible cord or string which is used for guiding the tracing tool, e.g. a pen or pencil. Such known arrangements, however, are not convenient to use, and many are not accurate with respect to the ellipse traced.

BRIEF SUMMARY OF THE INVENTION

An object of the present invention is to provide a handheld compass-type instrument for tracing curved figures, and particularly for drawing ellipses, which instrument may be conveniently-manipulated and accurately presettable for the specific configuration and dimensions of the figure to be traced.

According to a broad aspect of the invention, there is provided a compass-type instrument for tracing curved figures, comprising: a manipulatable finger-gripping element; an anchor arm mounted at one end to one end of the finger-gripping element, the opposite end of the anchor arm being adapted to be anchored to the surface on which the curve figure is to be traced; and a tracing arm pivotably mounted at one end to said one end of the finger-gripping element, the opposite end of the tracing arm being adapted to trace the curved figure on the mentioned surface. The instrument further includes an eccentric linkage, having presettable means for presetting its eccentricity, coupled between the anchor and tracing arms for constraining the tracing arm to pivot in a presettable eccentric manner with respect to the anchor arm when the finger-gripping element is manipulated to trace the figure.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF THE PREFERRED EMBODIMENT

Figure 1:
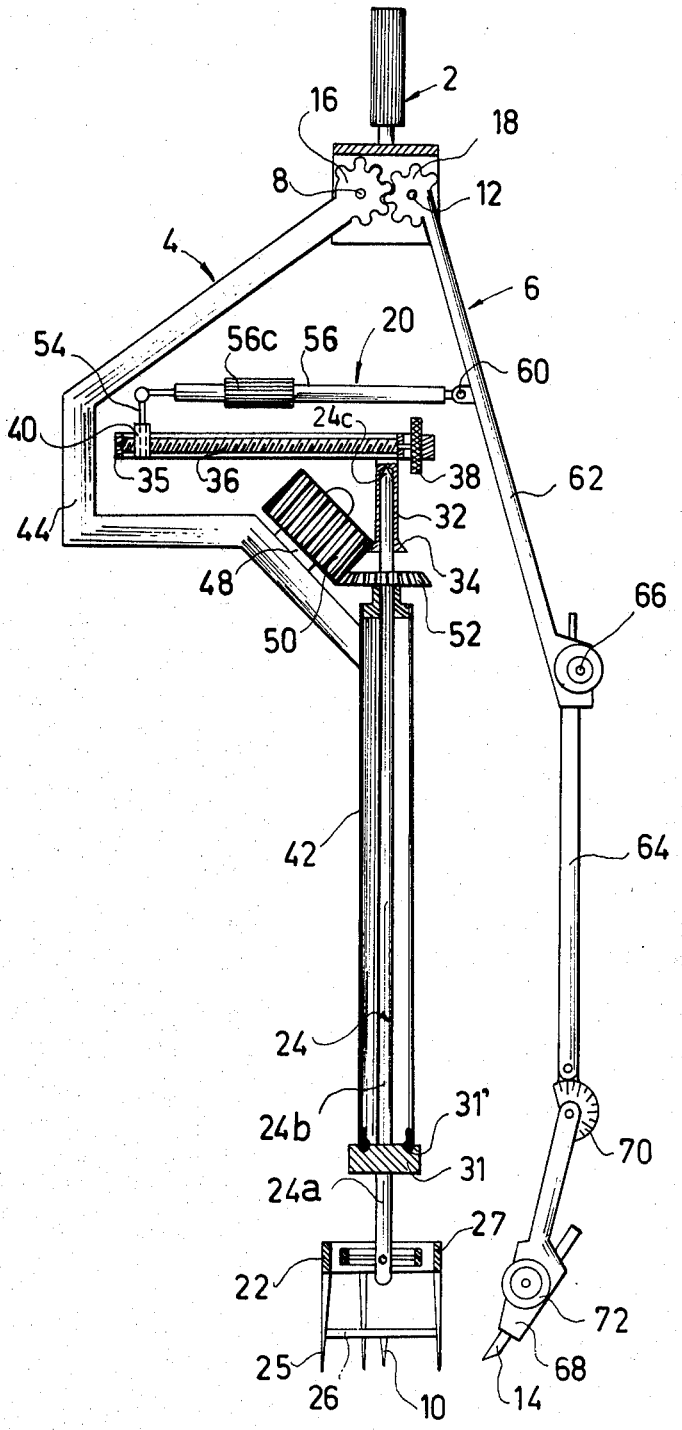
FIG. 1 is a front elevational view, partly in section, of one form of tracing instrument constructed in accordance with the invention.
Figure 3:
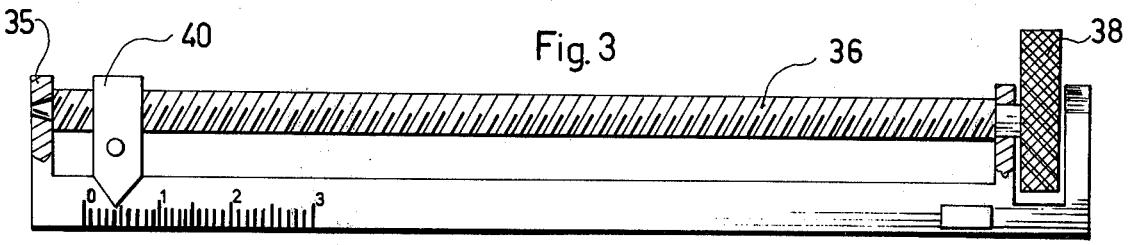
FIG. 3 is an enlarged view, partly in section, illustrating a portion of the eccentric linkage in the device of FIG. 1.

The device illustrated in the drawings is a hand-held compass-type instrument for tracing ellipses. Briefly, it comprises a finger-gripping manipulatable element 2, an anchor arm 4 adapted to be anchored to the surface on which the curved figure is to be traced, and a tracing arm 6 adapted to trace the curved figure, in this case an ellipse. The upper end of the anchor arm 4 is pivotably mounted by pin 8 to the finger-gripping element 2, the lower end of the arm being pointed, as shown as 10, for anchoring same to the tracing surface. The upper end of the tracing arm 6 is similarly pivotably mounted by pin 12 to the fingergripping element 2, and the lower end of arm 6 carries the tracing device, such as a pen or pencil, shown as 14 in FIG. 1. The two pivotal ends of arms 4 and 6 are coupled together by sector gears 16 and 18 so that the pivotal displacement of one arm produces a corresponding pivotal displacement of the other.

An eccentric linkage, generally designated 20 and to be described more particularly below, is coupled between anchor arm 4 and tracing arm 6. Eccentric linkage 20 includes presettable means for presetting its eccentricity, such that the linkage constrains the tracing arm to pivot in a presettable eccentric manner with respect to the anchor arm when the finger-gripping element is manipulated to trace the figure.

Figure 2:
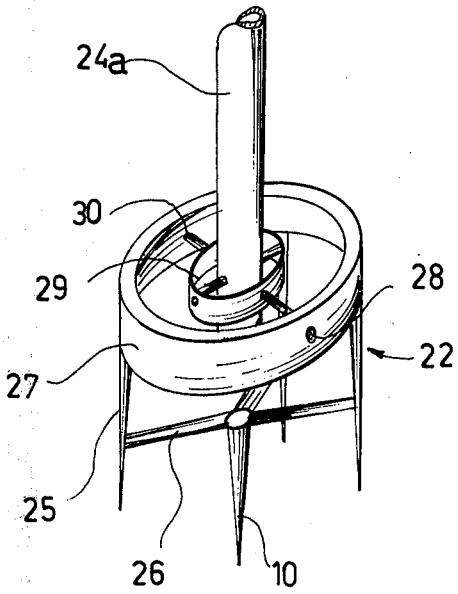
FIG. 2 is a three-dimensional view illustrating the end of the anchor arm in the device of FIG. 1.
Figure 5:
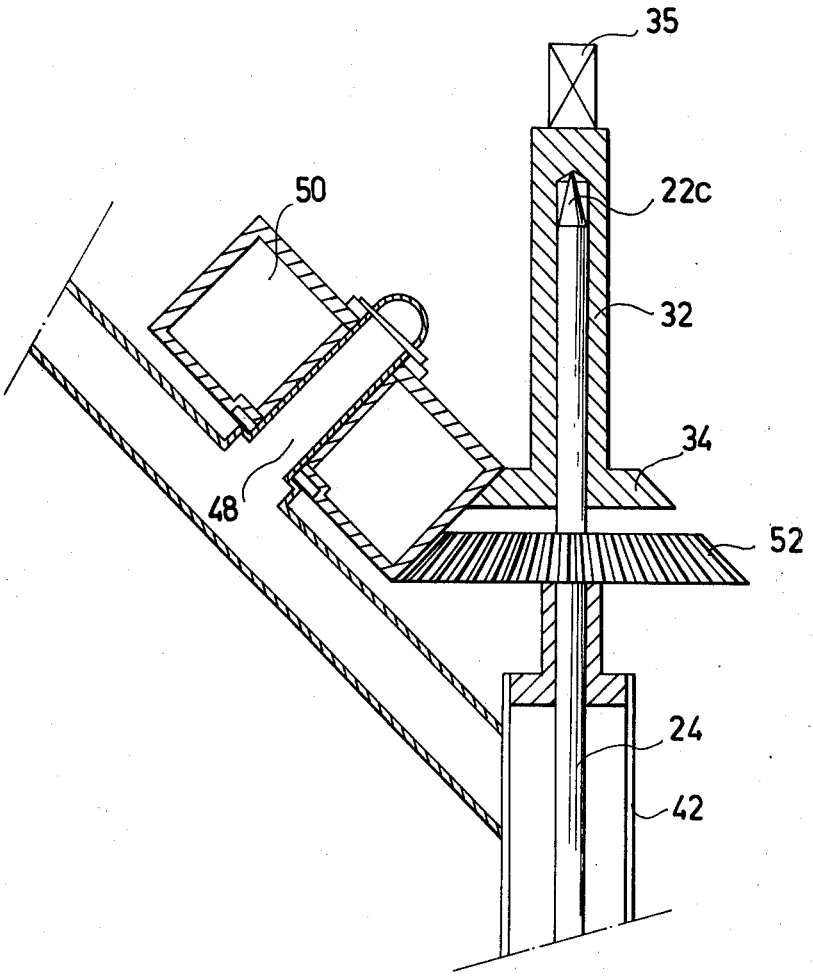
FIG. 5 is an enlarged sectional view of the gear transmission in the device of FIG. 1.

The pointed end 10 of the anchor arm 4 is carried at the center of the lower end of a foot 22 (FIG. 2) which provides a universal mounting for a center rod 24 enabling the rod to be pivoted in all directions with respect to the tracing surface when the pointed end 10 is inserted into it. Foot 22 comprises three vertical legs 25 fixed at their lower ends to the free ends of a Y-shaped base member 26 having a prong, constituting the pointed end 10, at its center. An outer gimbal ring 27 is fixed to the upper end of arms 25, and pivotably mounts, on axis 28 (FIG. 2), an inner gimbal ring 29. The center rod 24 is pivotably mounted to the inner gimbal ring 29 by means of a removable pin 30 at right angles to axis 28.

The lower end of the center rod 24 pivotably mounted by pin 29 is of tubular shape, as shown at 24*a*, and includes a disc 31 formed with an annular groove 31'. The middle portion of the center rod is of solid construction, as shown at 24*b*, and extends vertically above disc 31.

The upper end of the center rod 24 is pointed, as shown at 24*c*, and serves as a bearing for rotatably mounting a sleeve 32. The lower end of sleeve 32 fixedly carries a bevel gear 34, and the upper end fixedly carries a bracket 35 supporting a helically-threaded rod or screw 36 constituting a part of the eccentric linkage 20. Screw 36 carries a knurled head 38 facilitating the manual turning of the screw, and receives a nut 40 which is axially displaced along the length of the rod by the turning of its head 38.

Anchor arm 4 further includes an outer sleeve 42 fixed to the upper portion 44 of the anchor arm and rotatably received at its lower end within groove 31' of disc 31 carried by the lower end of the center rod 24. The upper portion 44 of the anchor arm 4 further includes a pin 48 rotatably mounting a gear 50 such that one side of the gear meshes with the previously-mentioned bevel gear 34 of sleeve 32, and the other side meshes with another bevel gear 52 fixed to the center rod 24.

Gears 50, 52 and 34 are part of a transmission which couples the anchor arm 4 to the eccentric linkage 20, particularly to the screw 36 of that linkage. Thus, as the upper portion 44 of the anchor arm 4 is rotated about the center rod 24 (the latter being non-rotatably but tiltably, anchored to the tracing surface by prong 10 and the universal mounting gimbals 27, 29), gear 50 carried by anchor arm portion 44 is rotated about bevel gear 52 carried by the center rod 24. Gear 50 thereby rotates bevel gear 34 about the center rod 22, and also rotates the screw 36 of the eccentric linkage 20 about the bearing point 24c of the center rod 24. In order to trace an ellipse, the conversion ratio of the above coupling should be 1:2, that is, the circumference of gear 52 should be twice that of gear 34, such that screw 36 of the eccentric linkage 20 is rotated two revolutions for each revolution of the outer sleeve 42 and of anchor arm portion 44.

Figure 4:
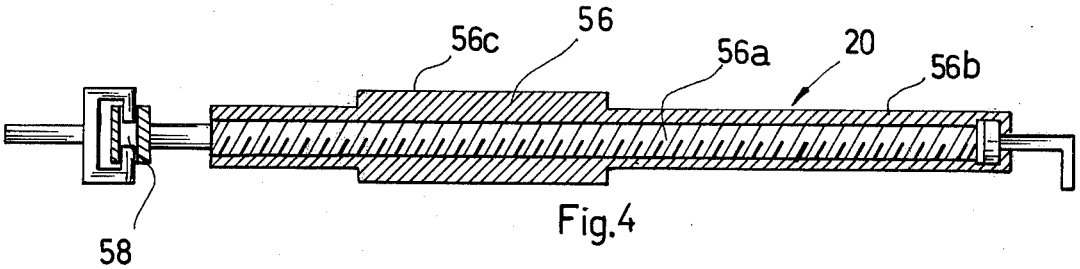
FIG. 4 is an enlarged sectional view of another element of the eccentric linkage in the device of FIG. 1.

The eccentric linkage 20 includes, in addition to screw 36 constituting a first link of this linkage, a pin 54 receivable within an opening in nut 40 of screw 36, and a second link 56 coupled between pin 54 and the tracing arm 6. Link 56 is made of two sections, namely an inner rod 56a (FIG. 4) pivotably mounted at one end 58 to pin 54, and an outer sleeve 56b rotatably and pivotably mounted with respect to a lug 60 carried by the tracing arm 6. The inner rod 56a is externally threaded, and the outer sleeve 56b is internally threaded and is provided with a knurled knob 56c to facilitate turning sleeve 56b with respect to the inner rod 56a and thereby to preset the distance between nut 40 and the tracing arm 6.

The tracing arm 6 may be of conventional construction such as used in drawing compasses, including an upper section 62, an intermediate section 64 pivotably and releasably held to section 62 by a threaded fastener 66, and a lower section 68 constituting a holder for the tracing device 14. Holder 68 is pivotable to section 64 by connection 70, and the tracing device 14 (e.g. pen or pencil) is releaseably secured within the holder by a threaded pin 72.

It will thus be seen that the tracing instrument illustrated in the drawings provides two presettable means for presetting the configuration and dimensions of the figure to be traced. Thus, knurled head 38 of screw 36 may be turned to preset the position of nut 40, and thereby to introduce the degree of eccentricity provided by the eccentric linkage 20; that is, when nut 40 is exactly aligned with the pointed end 24c of the center rod 24, the eccentricity is zero, and is increased according to the distance nut 40 is displaced from this position. In addition, the knurled knob 56c of the link 56 may be turned to change the effective length of the link between nut 40 and the tracing arm 64, and thus to introduce a fixed distance between the two.

When both head 38 and knob 56c have both been preset for the desired configuration and dimensions, the user merely grasps the finger-gripping element 2, inserts pointed end 10 into the surface (e.g. paper) on which the curved figure is to be traced, and rotates the instrument to cause the tracing device 14 at the end of the tracing arm 6 to traverse one complete revolution around the pointed end 10 of the anchor arm 4. Since the conversion ratio between the gears 52, 50 and 34 is 1:2, as discussed above, whereby two revolutions of the eccentric linkage 20 will be produced for each revolution of the tracing arm 6, it will be seen that, assuming the parts are in their position are illustrated in FIG. 1, tracing arm 6 will be moved as follows: during the first 90-degrees of rotation of the tracing arm 6, the arm will be constrained by the eccentric linkage to move radially away from the center point of the figure traced (defined by the pointed end 10 of the anchor arm 4); for the second 90-degrees of rotation, it will move radially towards the center point; for the third 90-degrees of rotation, it will again move radially away from the center point; and for the fourth 90-degrees of rotation, it will again move radially towards the center point. This movement will trace an illipse whose configuration and dimensions are determined by the settings of head 38 and knob 56c.

While the invention has been described with respect to one preferred embodiment, it will be appreciated that many variations, modifications, and other applications of the invention may be made.

What is claimed is:

1. A compass-type instrument for tracing curved figures, comprising: a manipulatable finger-gripping element; an anchor arm mounted at one end to one end of said finger-gripping element, the opposite end of said anchor arm being adapted to be anchored to the surface on which the curved figure is to be traced; a tracing arm pivotably mounted at one end to said one end of the finger-gripping element, the opposite end of said tracing arm being adapted to trace the curved figure on said surface; and an eccentric linkage, having presettable means for presetting its eccentricity, coupled between said anchor and tracing arms for constraining the tracing arm to pivot in a presettable eccentric manner with respect to the anchor arm when the finger-gripping element is manipulated to trace the figure, said eccentric linkage comprising a first link coupled at one end of said anchor arm, and a second link having one end presettable along the length of said first link, the opposite end of said second link being coupled to said tracing arm.

2. An instrument according to claim 1, wherein said second link includes adjustable means for presetting the length thereof between its said one end and said tracing arm.

3. An instrument according to claim 1, wherein said first link comprises a rod formed with screw threads and receiving a nut displaceable along the length of the rod upon rotating same, said one end of the second link being coupled to said nut.

4. An instrument according to claim 1, wherein said one end of the anchor arm is pivotably mounted to said finger-gripping element and is coupled to said one end of the tracing arm so as to pivot therewith.

5. An instrument according to claim 1, wherein said anchor arm comprises a center rod adapted to be non-rotatably anchored to the surface on which the figure is to be traced, an outer sleeve rotatably mounted with respect to said center rod, and a coupling between said outer sleeve and said eccentric linkage to rotate the latter linkage, and thereby to pivot the tracing arm in an eccentric manner with respect to the anchor arm, when the finger-gripping element is manipulated to trace the figure.

6. An instrument according to claim 5, wherein said coupling means has a conversion ratio of 1:2 such that the eccentric linkage is rotated two revolutions for each revolutions of the outer sleeve of the anchor arm, whereby the device traced is an ellipse

7. An instrument according to claim 5, wherein said coupling means comprises a first gear fixed to said outer sleeve, a second gear fixed to said center rod and meshing with said first gear, and a third gear also meshing with said first gear so as to be rotated thereby, said third gear being coupled to said eccentric linkage to rotate same when the finger-gripping element is manipulated to trace the figure.

8. An instrument according to claim 4 wherein said anchor arm comprises a foot having a pointed end for inserting into the surface onto which the curved figure is to be traced, said foot including a universal mounting for said center rod permitting same to be non-rotatably tilted in all directions and a support for said outer sleeve permitting it to be rotated with respect to the center rod

9. An instrument according to claim 8, wherein said universal mounting comprises a pair of gimbal rings.

* * * * *